United States Patent [19]

Ichimura

[11] Patent Number: 4,982,961

[45] Date of Patent: Jan. 8, 1991

[54] GAME WITH SPINNING TOPS

[75] Inventor: Takahiko Ichimura, Tokyo, Japan

[73] Assignee: Tomy Company, Ltd., Tokyo, Japan

[21] Appl. No.: 396,919

[22] Filed: Aug. 22, 1989

[30] Foreign Application Priority Data

Aug. 24, 1988 [JP] Japan ..... 63-110864

[51] Int. Cl.[5] ..... A63B 67/14; A63H 1/06

[52] U.S. Cl. ..... 273/109; 273/110; 446/259

[58] Field of Search ..... 273/108–110; 446/259

[56] References Cited

U.S. PATENT DOCUMENTS

| | | | |
|---|---|---|---|
| 1,552,530 | 9/1925 | Woods | 273/108 |
| 2,547,369 | 4/1951 | Bourelle et al. | 446/259 |
| 3,643,951 | 2/1972 | Breslow | 273/108 |
| 3,643,954 | 2/1972 | Meyer et al. | 273/119 A |
| 4,061,334 | 12/1977 | Kanno | 273/109 |
| 4,200,283 | 4/1980 | Andrews et al. | 273/108 |
| 4,575,346 | 3/1986 | Ogawa | 446/259 |

FOREIGN PATENT DOCUMENTS

| | | | |
|---|---|---|---|
| 390026 | 2/1924 | Fed. Rep. of Germany | 273/108 |

*Primary Examiner*—Randall L. Green
*Assistant Examiner*—Gary Jackson
*Attorney, Agent, or Firm*—Staas & Halsey

[57] ABSTRACT

A game for spinning tops includes a stage having an upper surface, and a pair of launching devices, each of which includes a pivotally mounted guide which receives a spinning top from above and discharges the spinning top from the side onto the upper surface of the stage.

17 Claims, 1 Drawing Sheet

GAME WITH SPINNING TOPS

BACKGROUND OF THE INVENTION

1. Field of the Invention

The present invention relates generally to amusement devices and, more specifically, to top spinning toys and games played therewith.

Spinning tops are generally known, and usually have a pull string to initiate high speed rotation which imparts dynamic stability in a top.

U.S. Ser. No. 232,009, filed Aug. 15, 1988 in the name of Tomy Company, Limited (Assignee herein) describes a spring-wound device for spinning tops. Basically, tops are provided with an exterior helical screw thread which engages a matching groove provided on the interior of a holder. The holder is rotated at a high speed by a spring-wound motor and thus delivers the high speed rotation to the top through the screw thread engagement.

The device for spinning a top described above is uniquely suitable for launching spinning tops from any desired position, so long as the device is substantially vertically oriented.

A game which is played with spinning tops on a stage is disclosed in Japanese Utility Model Publication (Jikkai) SHO No. 47-25679. The game described in the above-mentioned Japanese publication is rather straight-forward in the manner in which tops are transferred to a certain position on the stage from the perimeter of the stage. Since spinning tops are inherently difficult to direct, a device for launching spinning tops in a particular direction onto the stage would add another dimension of play to the game and thus enhance a player's enjoyment of the game.

SUMMARY OF THE INVENTION

An object of the present invention is to provide a game for spinning tops in which the player has the ability to launch spinning tops in a particular direction.

Another object of the invention is to provide a game for spinning tops in which spinning tops are launched by opposing players from opposite sides of a stage with the goal of knocking the other player's top off the stage.

Another object of the present invention is to provide a game for spinning tops which is relatively simple in construction and cost effective to produce.

These and other objects of the invention are met by providing a game for spinning tops which includes a stage having an upper surface and first means disposed at a perimeter of the upper surface of the stage for launching a spinning top in a desired direction onto the stage. Preferably, the launching means includes a stationary base detachably coupled to the stage and having an upper end, and a guide pivotally coupled to the upper end of the base. A second launching mean is disposed at the perimeter of the upper surface of the stage substantially diametrically opposed to the first launching means. As a result, spinning tops launched by opposing players spin on the upper surface of the stage and eventually knock each other out so that the winning player is the one whose spinning top knocks the other player's top down or off the stage.

These and other features and advantages of the game for spinning tops, according to the present invention will become more apparent with reference to the following detailed description and drawings.

DETAILED DESCRIPTION OF THE PREFERRED EMBODIMENTS

Figure 1:
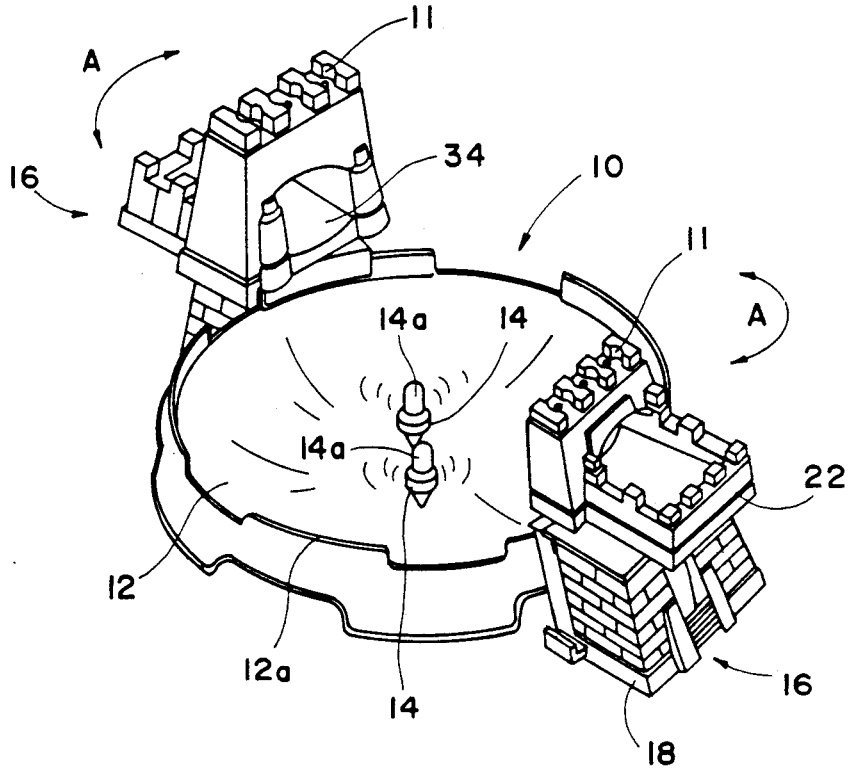
FIG. 1 is a perspective view of a first preferred embodiment of a game for spinning tops according to the present invention.
Figure 2:
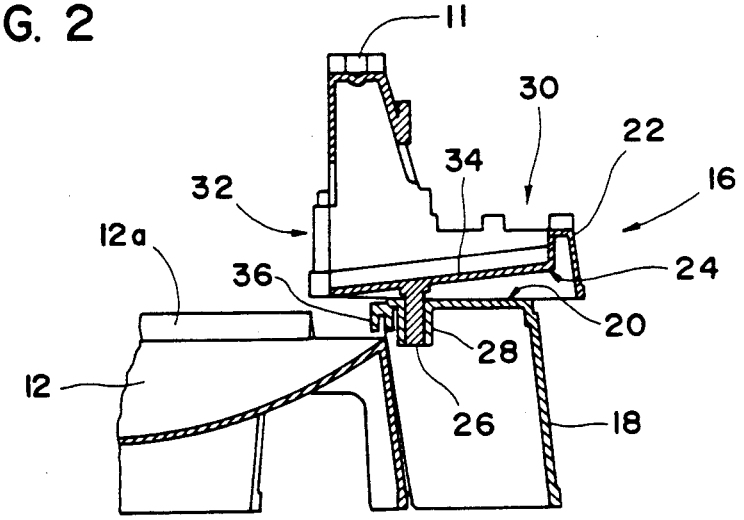
FIG. 2 is a partial cross-sectional view taken through one of the launching means illustrated in FIG. 1.

Referring to FIGS. 1 and 2, a game for spinning tops includes a stage 10 having an upper surface 12 which is concave-shaped. Spinning tops 14 launched by opposing players tend to move towards each other by virtue of the sloped, concave surface of the stage. Each top 14 has a headed portion **14*a*** which can be painted and shaped to resemble playing characters, warriors, etc.

Launching means 16 are disposed at a perimeter of the upper surface 12 at substantially diametrically opposed sides thereof so that opposing players can launch their respective spinning tops. The launching means 16 are capable of launching the spinning tops in a desired direction. Each launching means 16 includes a stationary base 18 which is detachably coupled to the stage, and having an upper end 20, and a guide 22 pivotally coupled to the upper end 20 of the base 18.

The lower surface 24 of the guide 22 is provided with a downwardly extending pivot post 26 which is journalled in a hole 28 formed in the upper end 20 of the base 18. Thus, the guide 22 is pivotal about a substantially vertical axis, as indicated by the directional arrow "A".

Each guide 22 has an axial opening 30 for receiving a spinning top 14 which has been discharged rotating at a high rate of speed from a top spinner, such as what is described in the aforementioned U.S. patent application. Preferably, the top spinner (not shown) is held about 30 millimeters from the axial opening 30, and then the release button is hit so as to discharge the spinning top downwardly and axially into the opening 30.

A lateral opening 32 allows the spinning top to pass onto the upper surface of the stage 12. A sloped, concave surface 34 is common to both the lateral and axial openings and slopes towards the upper surface 12 of the stage 10.

A retaining wall **12*a* is formed on the perimeter of the upper surface 12 and functions to keep the spinning tops on the upper surface, and also provides a mounting rim for connecting the stationary base 18 to the perimeter of the upper surface. The upper end, on the end board side, of the base 18 is provided with a flange 36 which has a groove into which the retaining wall 12*a* is fitted. In the illustrated embodiment, the retaining wall 12*a*** is segmented; however, the retaining wall could also be a continuous wall.

The stage and launching means are designed to emulate a citadel. At the upper end of each launching means 16, retainers 11 are formed for holding extra tops prior to spinning and release onto the stage.

The present invention as described herein prevents one player from having an advantage over the other when placing the spinning tops onto the stage. The game described herein also has the advantage in that interest in the game is heightened by the added dimension that imitates combatants appearing to do battle on a stage after leaving a citadel.

It should also be noted that in addition to providing pivotal movement by virtue of the pivotal mounting of the guide 22, the stationary base may, if desired, be moved along the perimeter by sliding on the retaining wall 12*a*. Thus, at times, the stationary base 18 may be moved to a desired position prior to launching the spinning top.

Numerous modifications and adaptations of the present invention will be apparent to those so skilled in the art and thus, it is intended by the following claims to cover all such modifications and adaptations which fall within the true spirit and scope of the invention.

What is claimed:

1. A game for spinning tops comprising:

a stage having an upper surface; and first means disposed at a perimeter of the upper surface of the stage for launching a spinning top in a desired direction onto the stage, wherein the first launching means includes a stationary base detachably coupled to the stage and having an upper end, and a guide pivotally coupled to the upper end of the base.

2. A game according to claim 1, wherein the guide has an axial opening for receiving a spinning top and a lateral opening through which the spinning top passes when launched onto the stage.

3. A game according to claim 2, further comprising a sloped, concave surface common to the lateral and axial openings and sloping toward the upper surface of the stage.

4. A game according to claim 1, wherein the upper surface of the stage is concave.

5. A game according to claim 1, wherein the guide is pivotal about a substantially vertical axis.

6. A game according to claim 1, further comprising a retaining wall upstanding from the perimeter of the upper surface of the stage.

7. A game according to claim 6, wherein the stationary base has a flange for mounting the stationary base on the retaining wall.

8. A game according to claim 1, wherein a hole is formed in the upper end of the base and a pivot post protrudes downwardly from a lower end of the guide and is journalled in the hole of the guide for pivotally mounting the guide.n

9. A game according to claim 1, further comprising second launching means disposed at the perimeter of the upper surface of the stage substantially diametrically opposed to the first launching means.

10. A game for spinning tops comprising:

a stage having an upper surface;

first means disposed at a perimeter of the upper surface of the stage for launching a spinning top in a desired direction onto the stage; and second launching means disposed at the perimeter of the upper surface of the stage substantially diametrically opposed to the first launching means, wherein the first launching means includes a stationary base detachably coupled to the stage and having an upper end, and a guide pivotally coupled to the upper end of the base.

11. A game according to claim 10, further comprising a retaining wall upstanding from the perimeter of the upper surface of the stage.

12. A game according to claim 11, wherein the stationary base has a flange for mounting the stationary base on the retaining wall.

13. A game according to claim 10, wherein the guide has an axial opening for receiving a spinning top and a lateral opening through which the spinning top passes when launching onto the stage.

14. A game according to claim 13, further comprising a sloped, concave surface common to the lateral and axial openings and sloping toward the upper surface of the stage.

15. A game according to claim 10, wherein the upper surface of the stage is concave.

16. A game according to claim 10, wherein the guide is pivotal about a substantial vertical axis.

17. A game according to claim 10, wherein a hole is formed in the upper end of the base and a pivot post protrudes downwardly from a lower end of the guide and is journalled in the hole of the guide for pivotally mounting the guide.

* * * * *